United States Patent [19]

Mizuno et al.

[11] Patent Number: 4,920,916

[45] Date of Patent: May 1, 1990

[54] ELECTROSTATIC LATENT IMAGE DEVELOPING DEVICE

[75] Inventors: Hiroshi Mizuno; Toshiya Natsuhara; Yuji Enoguchi; Akihito Ikegawa; Masasi Yamamoto; Hiroshi Murasaki, all of Osaka, Japan

[73] Assignee: Minolta Camera Kabushiki Kaisha, Osaka, Japan

[21] Appl. No.: 323,854

[22] Filed: Mar. 15, 1989

[30] Foreign Application Priority Data

| | | | |
|---|---|---|---|
| Mar. 16, 1988 | [JP] | Japan | 63-64525 |
| Aug. 8, 1988 | [JP] | Japan | 63-197759 |
| Aug. 22, 1988 | [JP] | Japan | 63-207740 |
| Nov. 17, 1988 | [JP] | Japan | 63-291825 |

[51] Int. Cl.[5] ..... G03G 15/08

[52] U.S. Cl. ..... 118/653; 118/261; 355/245; 355/259

[58] Field of Search ..... 355/245, 259; 118/656–658, 261, 262, 413, 414, 653

[56] References Cited

U.S. PATENT DOCUMENTS 4,791,882 12/1988 Enoguchi et al. .

FOREIGN PATENT DOCUMENTS 55-76362 6/1980 Japan .
60-46577 3/1985 Japan .

*Primary Examiner*—R. L. Moses
*Attorney, Agent, or Firm*—Burns, Doane, Swecker & Mathis

[57] ABSTRACT

A developing device including a toner support member for supporting toner on its surface, which is so provided as to confront an electrostatic latent image support member and a regulation member for forming a thin layer of the toner on the toner support member, which includes a curved member for pressing the toner support member and a support member for supporting the curved member such that an area S of a space satifies an equation: $0<S\leqq 0.15\ mm^2$ wherein the space is defined in a radial plane of the toner support member and the curved member and is bounded by the toner support member, the curve member and a line drawn in parallel with a normal extending through a point of contact between the toner support member and the curved member and spaced a radius of curvature of the curved member from the normal at an upstream side of the normal in a direction of rotation of the toner support member.

25 Claims, 11 Drawing Sheets

ELECTROSTATIC LATENT IMAGE DEVELOPING DEVICE

BACKGROUND OF THE INVENTION

The present invention relates to a developing device for use in an electrophotographic copying apparatus, a printer or the like.

In response to a recent keen demand for more compact and more inexpensive copying apparatuses, printers, etc., there is a tendency that developing devices of a type employing non-magnetic toner as one-component developer are utilized in the copying apparatuses, the printers, etc. The developing devices of this kind are provided with a toner support member having a movable surface for supporting toner and a regulation member for electrically charging the toner supplied onto the toner support member and for regulating amount of the toner adhering to the toner support member. In such developing devices, it is essential to form a properly charged toner layer of a proper thickness on the toner support member.

As shown in FIG. 1, a typical example of the known regulation member is a blade 2 which is formed by an elastic plate and is pressed against a toner support member 1. However, in case the blade 2 is employed, amount of the toner adhering to the toner support member 1 varies according to a dimension l of a projecting portion of the blade 2. This projecting portion of the blade 2 extends from a point P of contact between the blade 2 and the toner support member 1 to a distal end of the blade 2.

FIG. 2 shows relation between a length L of the blade 2 and amount M (mg/cm$^2$) of the toner adhering to the toner support member 1 in the case where the blade 2 is pressed against the toner support member 1 of a sleeve type shown in FIG. 1. In order to obtain a practical thin layer of the toner on the toner support member 1 shown in FIG. 1, the amount M of the toner adhering to the toner support member 1 should range from 0.4 to 0.5 mg/cm$^2$. If the dimension l of the projecting portion of the blade 2 for securing the practical amount M of the toner adhering to the toner support member 1 is determined in FIG. 2, the dimension l of the projecting portion of the blade 2 should range from 0 to 0.5 mm corresponding to the length L of 22.0 to 22.5 mm. However, such a problem arises that the developing device is required to be assembled with extremely high precision in order to obtain the dimension l of the projection portion of the blade 2 accurately.

In order to solve this problem, Japanese Patent Laid-Open Publication (unexamined) No. 46577/1985, for example, proposes a method shown in FIG. 3 in which a curved portion 3 having a circular cross section is provided on the regulation member so as to be brought into contact with the toner support member 1. Such curved portion 3 has advantages that (1) a permissible setting width of the regulation member is increased and (2) since a motor for driving the toner support member can be made more compact due to reduction in a mechanical torque for rotating the toner support member, the developing device itself can be made more compact and can be manufactured at a lower cost.

The advantage (1) is gained as follows. Namely, if the curved portion 3 is employed, the dimension of the projecting portion of the blade becomes approximately identical with a radius r of curvature of the curved portion 3. Thus, if only the radius r of curvature of the curved portion 3 is obtained accurately, the dimension of projecting portion of the blade is kept substantially constant at the radius r of curvature. Therefore, even if the blade is set at slightly different locations on the toner support member 1 as shown in FIGS. 4*a*, 4*b* and 4*c* during assembly of the developing device, it becomes possible to form a stable thin layer of the toner on the toner support member at all times.

Meanwhile, the advantage (2) is described as follows. If the curved portion 3 is brought into contact with the toner support member 1 as shown in FIG. 5*a*, a nip (contact) width W' of the curved portion 3 becomes smaller than a nip width W of the flat blade 2 as shown in FIG. 5*b*. Therefore, when an identical thin layer of the toner is formed on the toner support member 1 in both cases of FIGS. 5*a* and 5*b*, a contact pressure of the curved portion 3 and the blade 2 per unit area of the toner support member 1 is required to be made equal to each other. It is, needless to say, apparent that the torque of the motor for driving the toner support member 1 in the case of the curved portion 3 having the nip width W' narrower than the nip width W of the flat blade 2 is advantageously smaller than that of the flat blade 2.

However, even in the case where the regulation member having the curved portion is employed, quantity of electric charge of the toner on the toner support member and amount of the toner adhering to the toner support member vary according to the radius of curvature of the curved portion and a radius of curvature of the toner support member held in contact with the curved portion and thus, finally obtained image quality may be adversely affected.

SUMMARY OF THE INVENTION

Accordingly, an essential object of the present invention is to provide a developing device employing a regulation member having a curved portion, in which quantity of electric charge of toner on a toner support member and amount of the toner adhering to the toner support member are set properly such that excellent image quality can be obtained in copying, printing, etc.

A further object of the present invention is to provide a developing device in which linearity of the curved portion of the regulation member is excellent so as to eliminate poor image quality such as non-uniform density, etc. of an image due to defective linearity of the curved portion and which not only can be easily manufactured easily even if the curved portion has a small radius of curvature but is suitable for mass production, thereby resulting in reduction of its production cost.

Another object of the present invention is to provide a developing device in which a stable and sufficient pressing contact pressure is secured between a developing roller and the regulation member at a toner supply portion so as to uniform electrical charging of the toner and a toner layer and the developing roller is stably brought into light contact with an electrostatic latent image support member at a location of confrontation between the developing roller and the electrostatic latent image support member so as to supply the toner to an electrostatic latent image on the electrostatic latent image support member.

Still another object of the present invention is to provide a developing device in which a uniform toner layer is formed on a surface of the toner support member without adhering to a toner regulating rod in the vicinity of a location of contact between the toner regulating rod and the surface of the toner support member and the toner regulating rod can be easily retained at a distal end portion of the regulation member without being distorted.

BRIEF DESCRIPTION OF THE DRAWINGS

This object and features of the present invention will become apparent from the following description taken in conjunction with the preferred embodiments thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 9:
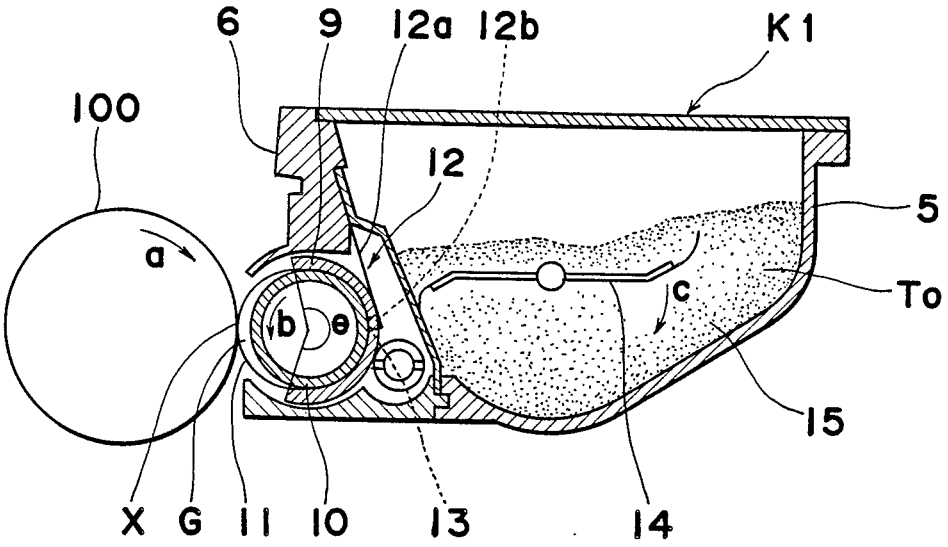
FIG. 9 is a schematic sectional view of a developing device according to a first embodiment of the present invention.
Figure 10:
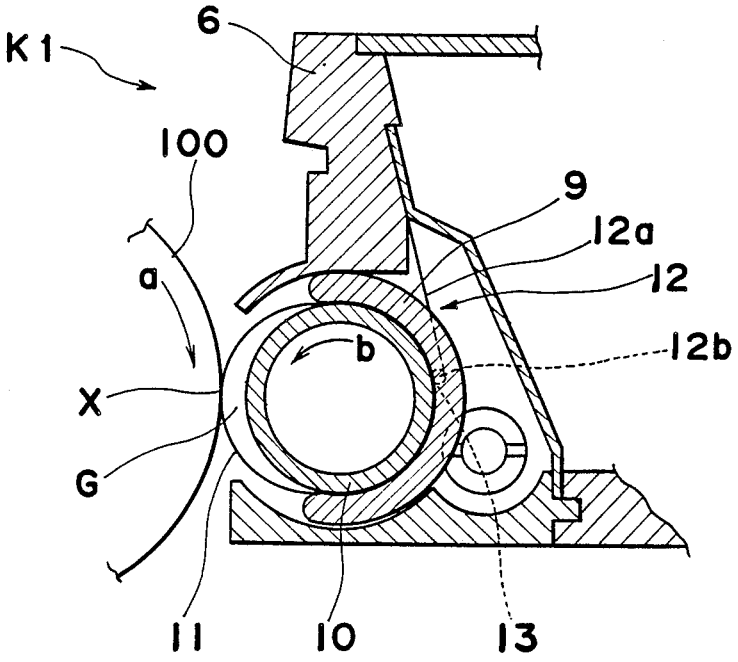
FIG. 10 is an enlarged fragmentary sectional view of the developing device of FIG. 9.

Referring now to the drawings, there is shown in FIGS. 9 and 10, a developing device K1 for use in an electrophotographic copying apparatus, a printer, etc., according to a first embodiment of the present invention. The developing device K1 is disposed adjacent to a photosensitive drum 100 driven for its rotation in the direction of the arrow a. The developing device K1 includes a rotatable drive roller 10, a tubular filmy member 11 fitted loosely around the drive roller 10, a guide member 9 for pressing the filmy member 11 against the drive roller 10, a regulation member 12 for regulating thickness of a toner layer on an external surface of the filmy member 11 through its pressing contact with the external surface of the filmy member 11 and a casing 5 for supporting and accommodating the members 9 to 12 and for storing toner To.

In the drive roller 10 driven for its rotation, an elastic member such as rubber, plastics, etc., to which electrical conductivity has been imparted, is coated on an electrically conductive member made of aluminum, etc. A developing bias voltage is applied to the drive roller 10. Since the drive roller 10 has elasticity, a permissible setting range of the regulation member 12 is increased.

The filmy member 11 is formed by a tubular film having a peripheral length slightly larger than that of the drive roller 10 and is loosely fitted around the drive roller 10 so as to form a small slack relative to the drive roller 10. It is desirable that the filmy member 11 is formed by a sheet made of soft resin, a sheet made of resin mixed with carbon, metallic powder or the like, a metallic film made of nickel, aluminum, etc. or a laminate sheet of the above described resinous sheet and the metallic film.

The guide member 9 has an arcuate internal surface substantially corresponding to an external surface of the drive member 10. Thus, when the filmy member 11 is brought into pressing contact with an outer peripheral portion of the drive roller 10 by the guide member 9, a slack of the filmy member 11 is formed in a concentrated manner at an opening of the guide member 9, which opening confronts the photosensitive drum 100. Therefore, a predetermined gap G is formed, at a location confronting the photosensitive drum 100, between the filmy member 11 and the drive roller 10 such that the filmy member 11 is brought into contact with the photosensitive drum 100. Meanwhile, the arcuate internal surface of the guide member 9 may be substantially of an arc having a central angle $\theta$ of about 180° to 270° so as to press the filmy member 11 against the drive roller 10 even if the arc has discontinuous portions partially. It is desirable that the guide member 9 is formed by molding synthetic resin such as polyethylene, nylon, polyacetal, polypropylene, etc.

Meanwhile, a coefficient $\mu 1$ of friction between the outer peripheral surface of the drive roller 10 and the inner peripheral surface of the filmy member 11 is so set as to be far greater than a coefficient $\mu 2$ of friction between the outer peripheral surface of the filmy member 11 and the guide member 9, i.e. $\mu 1 > \mu 2$. Thus, when the drive roller 10 is rotated in the direction of the arrow b, the filmy member 11 is also moved in synchronism with the rotation of the drive roller 10.

Furthermore, the regulation member 12 is attached to a rear face of a support member 6 provided above the drive roller 10. The regulation member 12 is constituted by a platelike elastic member **12*a* and a metallic circular rod 12*b* provided at a distal end of the elastic member 12*a*. The circular rod 12*b* is brought into contact, as a rigid member, with the filmy member 11. It is to be noted that the term "rigid member" means that when the circular rod 12*b* is pressed against the filmy member 11 on the drive member 10, the circular rod 12*b* is capable of forming a toner layer of a uniform thickness without distortion or deformation of the circular rod 12*b*. The circular rod 12*b* is made of, for example, iron, stainless steel. In the case where the drive roller 10 is made of elastic material, the circular rod 12*b* may be formed by molding synthetic resin such as polyethylene, polyacetal, Teflon (name used in trade and manufactured by E.I. du Pont de Nemours & Co., Inc. of the U.S.), etc. A contact surface of such rigid member, i.e. the circular rod 12*b* relative to the filmy member 11 assumes a curved surface. A desirable value of a radius of curvature of this curved surface changes according to a system speed of the machine such as the electrophotographic copying apparatus and the printer, a rotational torque of the developing device K1, a contact pressure of the regulation member 12** but usually ranges from 0.25 to 1.0 mm.

Figure 11:
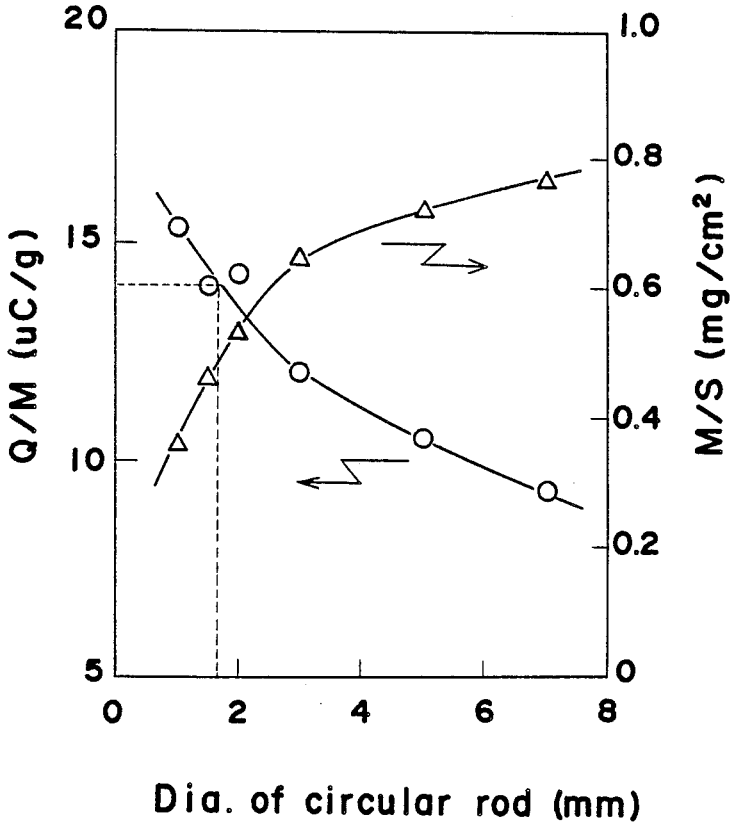
FIG. 11 is a graph showing relation among diameter of a circular rod, quantity of electric charge of toner and amount of transported toner in the developing device of FIG. 9.

FIG. 11 shows relation among diameter of the circular rod **12*b*, quantity Q/M of electric charge of the toner To and amount M/S of the transported toner To under conditions that the developing device K1 has a rotational torque of 1 kg.cm, the regulation member 12 has a contact pressure of 5 g/mm and the machine such as the electrophotographic copying apparatus, the printer, etc. has a system speed of 8 cm/sec. It is seen from FIG. 11 that when the diameter of the circular rod 12*b* exceeds 2 mm, namely, when the radius of curvature of the circular rod 12*b* exceeds 1 mm, amount of the toner To passing through the regulation member 12 increases and quantity of electric charge of the toner To decreases, thereby resulting in fog on a substrate of an image. Meanwhile, when the radius of curvature of the circular rod 12*b* is smaller than 0.25 mm, regulation of thickness of a toner layer on the filmy member 11 by the regulation member 12 becomes unstable because not only it is difficult to form the circular rod 12*b* linearly but strength of the circular rod 12*b* is reduced. However, the radius of curvature of the circular rod 12*b*** is not restricted to the above described range but may exceed 1 mm in the case where the machine such as the electrophotographic copying apparatus, the printer, etc. has a high system speed.

Meanwhile, if the toner To has positive polarity, the circular rod **12*b* is desirably made of material having polarity more negative than that of the toner To in frictional series, for example, metals such as iron, stainless steel, etc. and these metals having a coating of fluoroplastics formed thereon. On the other hand, if the toner To has negative polarity, the circular rod 12*b*** is desirably made of material having polarity more positive than that of the toner To in frictional series, for example, metals such as iron, stainless steel, etc. and these metals having a coating of amine resin.

The elastic member **12*a* of the regulation member 12** are formed by a thin sheet of magnetic metals, a thin sheet of non-magnetic metals such as stainless steel, phosphor bronze, etc., plastic materials such as Teflon, nylon, etc. or elastic composite material obtained by laminating these materials.

The casing 5 has a toner tank 15 for storing the toner To. In the toner tank 15, an agitator 14 rotatable in the direction of the arrow c is provided so as to carry the toner To in the direction of the arrow c while preventing blocking of the toner To stored in the toner tank 15.

As means for pressing the filmy member 11 against the drive roller 10, such a method can also be employed in place of the guide member 9 that a magnet is provided in the drive roller 10 so as to attract the filmy member 11 made of magnetic material.

Meanwhile, the drive roller 10 may also be formed by aluminum having rough surface by blasting or electrically conductive material such as aluminum having an electrically conductive and elastic rubber layer formed on its surface.

Meanwhile, so-called one-component type non-magnetic toner is suitably used as the toner for the developing device K1 but may be replaced by magnetic toner, etc.

Hereinbelow, operation of the developing device K1 is described with reference to FIG. 9. The drive roller 10 and the agitator 14 are, respectively, rotated in the direction of the arrows b and c by a driving source (not shown) such that the toner To is forcibly carried in the direction of the arrow c by the agitator 14. On the other hand, the filmy member 11 is rotatively displaced in the direction of the arrow b together with the drive roller 10 due to a frictional force produced between the filmy member 11 and the drive roller 10. The toner To in the toner tank 15 adheres to the surface of the filmy member 11 through its contact with the filmy member 11 and by electrostatic force of the toner To so as to be conveyed in the direction of the arrow b by the filmy member 11. The toner To is introduced into a wedgy region 13 defined between the filmy member 11 and the circular rod **12*b* provided at the distal end of the regulation member 12. Then, the toner To reaches a location of pressing contact between the circular rod 12*b* of the regulation member 12 and the the filmy member 11 so as to be not only coated, as a thin layer, on the surface of the filmy member 11 but triboelectrically charged to a predetermined one of positive and negative polarities. The toner To held on the filmy member 11 by electrostatic force produced by electrical charging of the toner To is further transported to a location confronting the photosensitive drum 100, i.e. a developing region X. At the developing region X, the toner To proceeds, by an electric field based on potential difference between surface potential of the photosensitive drum 100 and the bias voltage applied to the drive roller 10, to the electrostatic latent image formed on the surface of the photosensitive drum 100** so as to form a toner image.

At this time, a portion of the filmy member 11 is held in contact with the photosensitive drum 100 so as to be held out of contact with the drive roller 10 such that the gap G is defined between the portion of the filmy member 11 and the drive roller 10. Thus, the filmy member 11 is brought into contact, by its own rigidity, with the photosensitive drum 100 at a proper nip width lightly and uniformly so as to keep a predetermined distance from the drive roller 10. Therefore, the toner on the filmy member 11 forms the electrostatic latent image on the photosensitive drum 100 into a uniform toner image. Meanwhile, it can also be so arranged that a peripheral speed of the photosensitive drum 100 and a speed of the filmy member 11 are different from each other because the toner image once formed on the photosensitive drum 100 is not disrupted by physical forces such as sliding contact pressure of the filmy member 11, etc.

The filmy member 11 having passed through the developing region X is further transported in the direction of the arrow b. Subsequently, the toner To is again supplied to the surface of the filmy member 11 and an electrically charged thin toner layer of a uniform thickness is formed on the surface of the filmy member 11 at the location of pressing contact between the circular rod **12*b* and the filmy member 11**. Thereafter, the above described operations are repeated.

In the developing device K1 according to the first embodiment of the present invention, the contact portion of the regulation member to be brought into contact with the filmy member is formed by a rigid member having a circular surface and the rigid member is supported by the elastic member. Therefore, the regulation member is brought into contact with the filmy member uniformly. Even if point of contact between the circular rod and the filmy member deviates due to variations of setting position of the circular rod relative to the drive roller or eccentricity of the drive roller, the regulation member is capable of regulating thickness of the toner layer uniformly.

Accordingly, at the toner supply portion, since a sufficient contact pressure of the regulation member can be secured stably at all times, potential of the charged toner can be increased to a desired value and a thin toner layer of a uniform thickness can be obtained.

Meanwhile, in the developing region, since the filmy member is brought into contact with the photosensitive drum at a sufficient nip width at a very low contact pressure stably and accurately, an image having stable density without non-uniform density can be formed through uniform supply of the toner to the electrostatic latent image.

Hereinbelow, a developing device K2 according to a second embodiment of the present invention is described with reference to FIGS. 6 to 8. Since constructions of the developing device K2 are the same as those of the developing device K1, detailed description thereof is abbreviated for the sake of brevity. In the developing device K2, a peripheral speed of the photosensitive drum 100 is set at about 8.5 cm/sec., while a peripheral speed of the filmy member 11 is set at about 25.5 cm/sec. The filmy member 11 acting as a toner support member may be obtained by forming electrically conductive rubber into a tubular shape but an electrically conductive thin film obtained by electroforming metals such as nickel, aluminum, titanium, chromium, molybdenum, tungsten, etc. or alloys such as brass, bronze, stainless steel, Co-$Al_2O_3$, Pb-$TiO_2$, Pb-TiC, etc. into an endless tubular shape can also be used as the filmy member 11. Furthermore, the filmy member 11 can also be formed by a soft endless film made of resins such as polycarbonate, nylon, polyester, fluoroplastics, etc. or by mixing carbon graphite, metals or electrically conductive fine powder such as fine powder of metallic oxides, etc. with resin. In the developing device K2, the filmy member 11 is formed by a thin film made of nickel.

Figure 1:
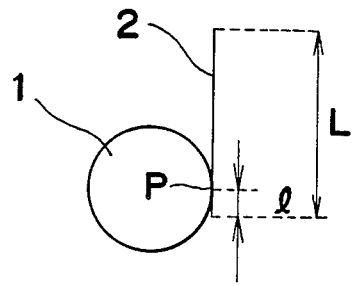
FIG. 1 is a view explanatory of a prior art developing device in which a blade type regulation member is pressed against a toner support member (already referred to)
Figure 2:
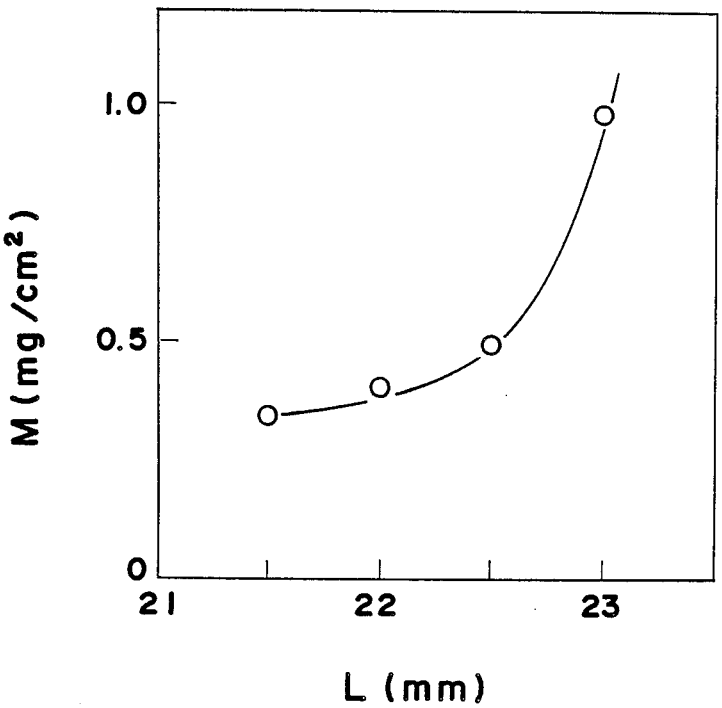
FIG. 2 is a graph showing relation between length of the regulation member and amount of toner adhering to the toner support member in the prior art developing device of FIG. 1 (already referred to)
Figure 3:
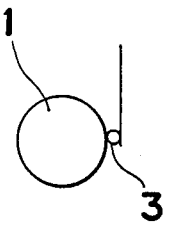
FIG. 3 is a view explanatory of another prior art developing device in which a curved portion provided on a regulation member is pressed against a toner support member (already referred to)
Figure 4A:
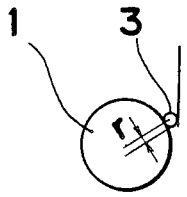
FIGS. 4*a*, 4*b* and 4*c* are views explanatory of states of setting of the curved portion on the toner support member in the prior art developing device of FIG. 3 (already referred to)
Figure 4B:
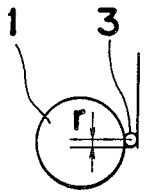
Figure 4C:
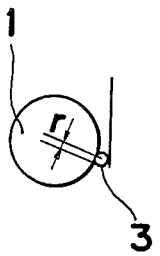
Figure 5A:
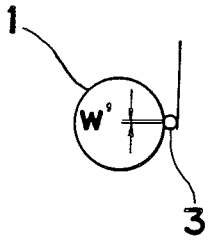
FIG. 5*a* is a view showing a nip width obtained in the case where the curved portion of the regulation member is pressed against the toner support member in the prior art developing device of FIG. 3.
Figure 5B:
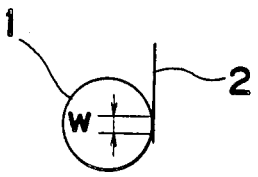
FIG. 5*b* is a view showing a nip width obtained in the case where the blade type regulation member is pressed against the toner support member in the prior art developing device of FIG. 1 (already referred to)
Figure 6:
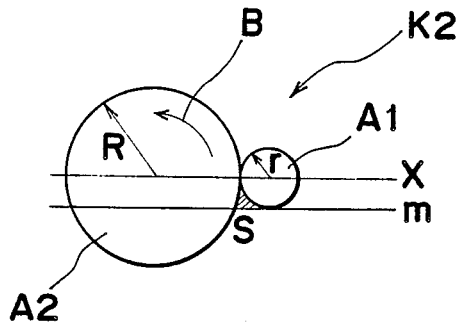
FIG. 6 is a view explanatory of an area of a space bounded by a curved portion of a regulation member and a toner support member in a developing device according to a second embodiment of the present invention.

Referring to FIG. 6, the area S of the space at which the circular rod **12*b* is brought into contact with the filmy member 11, the radius R of curvature of the filmy member 11 and the radius r of curvature of the circular rod 12*b*** are selected as shown in Examples 1 to 9 in Tables 1 to 3 below.

The area S of the space is described with reference to FIG. 6, hereinbelow. A normal X extends through a point of contact between a curved portion A1 of the regulation member and a toner support member A2 having a radius R of curvature. A line m extends in parallel with the normal X and is spaced a radius r of curvature of the curved portion A1 from the normal X at an upstream side of the normal X in a direction of rotation of the toner support member A2. The area S denotes an area of a space (hatched region) bounded by the curved portion A1, the toner support member A2 and the line m.

Figure 7:
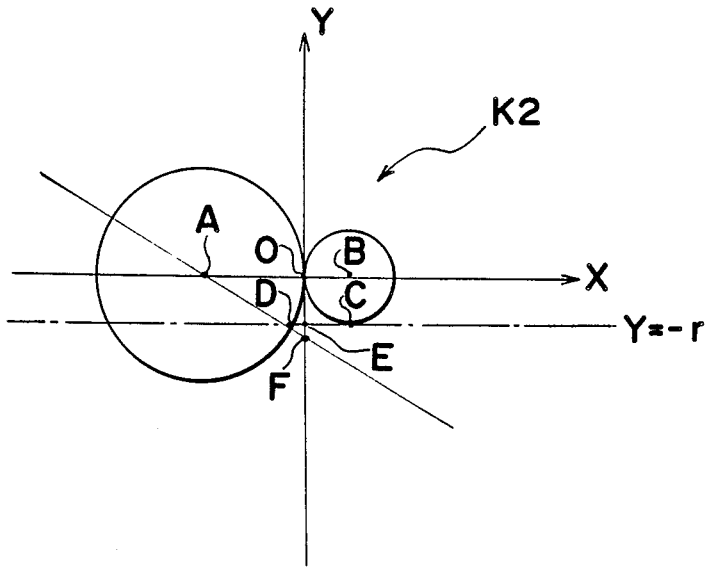
FIG. 7 is a view explanatory of calculation of the area of the space of FIG. 6.
Figure 8:
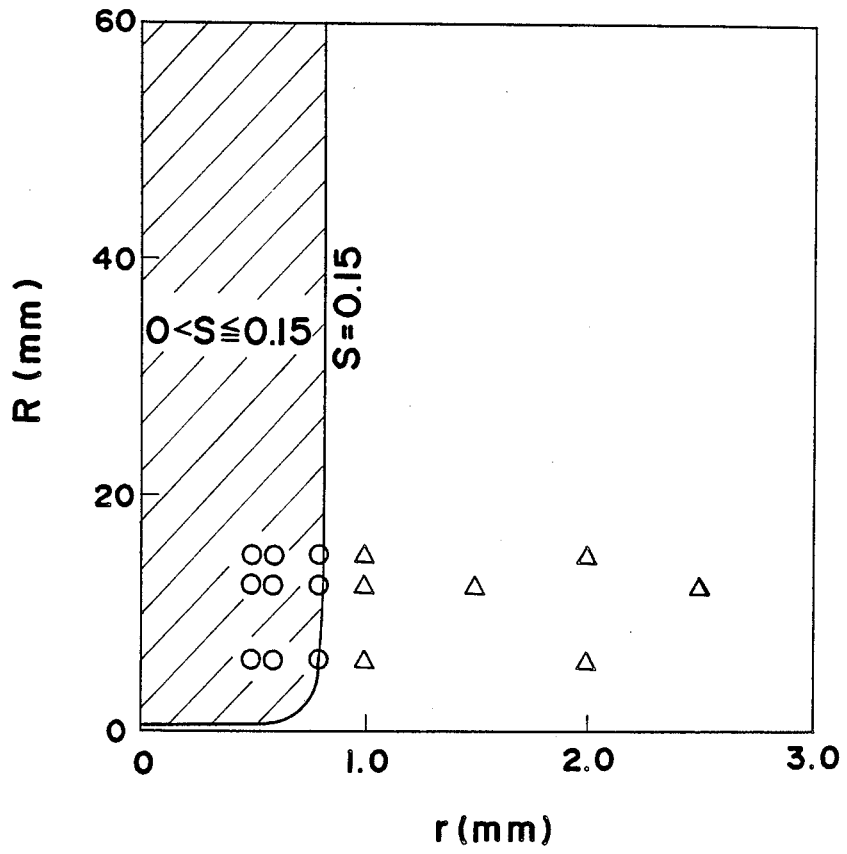
FIG. 8 is a graph showing relation between radiuses of curvature of the curved portion and the toner support member in a specific range of the area of the space of FIG. 6.

As shown in FIG. 7, supposing that character S1 denotes an area of a sector BOC, character S2 denotes an area of a region OEC, character S3 denotes an area of a triangle AOF, character S4 denotes an area of a sector AOD, character S5 denotes an area of a region OED, character S6 denotes an area of a square OBCE and character S7 denotes an area of a triangle DEF, the area S of the space is expressed by the following equation (1).

$$S = S2 + S5 \tag{1}$$

$$S2 = S6 - S1$$

$$S5 = S3 - S4 - S7$$

Meanwhile, the areas S6, S1, S3, S4 and S7 are given as follows.

$$S6 = r^2$$

$$S1 = \tfrac{1}{4} \cdot \pi r^2$$

$$S3 = \tfrac{1}{2} \cdot R \cdot \frac{Rr}{\sqrt{R^2 - r^2}}$$

$$S4 = \pi R^2 \cdot \frac{\tan^{-1} \dfrac{r}{\sqrt{R^2 - r^2}}}{360^\circ}$$

$$S7 = \tfrac{1}{2} \left(R - \sqrt{R^2 - r^2}\right) \left( \frac{Rr}{\sqrt{R^2 - r^2}} - r \right)$$

Namely, the area S of the space can be expressed as a function of the radiuses r and R of curvature, i.e. $S = f(r, R)$.

In each of the Examples 1 to 9, fine particles having an average particle diameter $D_{50}$ of about 11.5 μm obtained by mixing carbon black with polyester resin as a colorant and further, charge controlling agent therein is used as developer. By using a printer SP-130 (name used in trade and manufactured by Minolta Camera Kabushiki Kaisha of Japan), quantity Q (μC/g) of electric charge of the toner and image quality of finally obtained prints such as fog in the substrate, reproducibility of solid black, scatter of the developer around letters, etc. were examined. Meanwhile, Comparative Examples 1 to 8 having the area S larger than 0.15 $mm^2$ are also shown in Tables 1 to 3.

TABLE 1

| | Example 1 | Example 2 | Example 3 | Comp. Example 1 | Comp. Example 2 |
|---|---|---|---|---|---|
| S ($mm^2$) | 0.057 | 0.083 | 0.152 | 0.242 | 1.084 |
| r (mm) | 0.5 | 0.6 | 0.8 | 1.0 | 2.0 |
| Q (μC/g) | 15.8 | 14.7 | 14.5 | 12.4 | 10.4 |
| Image Quality | Good | Good | Good | Bad | Bad |

In Table 1 above, the radius R of curvature of the filmy member is set at 6 mm.

TABLE 2 (1)

| | Example 4 | Example 5 | Example 6 |
|---|---|---|---|
| S ($mm^2$) | 0.055 | 0.080 | 0.144 |
| r (mm) | 0.5 | 0.6 | 0.8 |
| Q (μC/g) | 15.3 | 14.7 | 14.2 |
| Image Quality | Good | Good | Good |

TABLE 2 (2)

| | Comp. Example 3 | Comp. Example 4 | Comp. Example 5 | Comp. Example 6 |
|---|---|---|---|---|
| S ($mm^2$) | 0.228 | 0.528 | 1.551 | 3.207 |
| r (mm) | 1.0 | 1.5 | 2.5 | 3.5 |
| Q (μC/g) | 12.2 | 12.0 | 10.6 | 9.3 |
| Image Quality | Bad | Bad | Bad | Bad |

In Tables 2(1) and 2(2) above, the radius R of curvature of the filmy member 11 is set at 12.5 mm.

TABLE 3

| | Example 7 | Example 8 | Example 9 | Comp. Example 7 | Comp. Example 8 |
|---|---|---|---|---|---|
| S ($mm^2$) | 0.055 | 0.080 | 0.143 | 0.226 | 0.948 |
| r (mm) | 0.5 | 0.6 | 0.8 | 1.0 | 2.0 |
| Q (μC/g) | 15.0 | 13.9 | 13.5 | 11.8 | 11.2 |
| Image Quality | Good | Good | Good | Bad | Bad |

In Table 3 above, the radius R of curvature of the filmy member 11 is set at 15.0 mm.

As is apparent from Tables 1 to 3, good image quality is obtained in the Examples 1 to 9 of the present invention, while bad image quality such as fog, etc. is obtained in the Comparative Examples 1 to 8. In the graph of FIG. 8, circular dots correspond to the Examples 1 to 9 and triangular dots correspond to the Comparative Examples 1 to 8. It is seen from Tables 1 to 3 that good image quality is obtained in all the Examples 1 to 9 in which the area S of the space is so set as to be not more than 0.15 $mm^2$.

In the developing device K2 according to the second embodiment of the present invention, the regulation member is provided with the curved portion such that the advantages obtained by the regulation member having the curved portion are obtained. Furthermore, since quantity of electric charge of the toner on the toner support member and amount of the toner adhering to the toner support member are set to proper values, excellent image quality can be obtained in copying, printing, etc.

Meanwhile, so-called one-component type non-magnetic toner is suitably used as the toner for the developing device of the present invention but may be replaced by magnetic toner, etc. Furthermore, the present invention is not restricted to the above mentioned developing device but can be applied to a conventional one-component type developing device and a toner replenishing device in a two-component type developing device.

Figure 12:
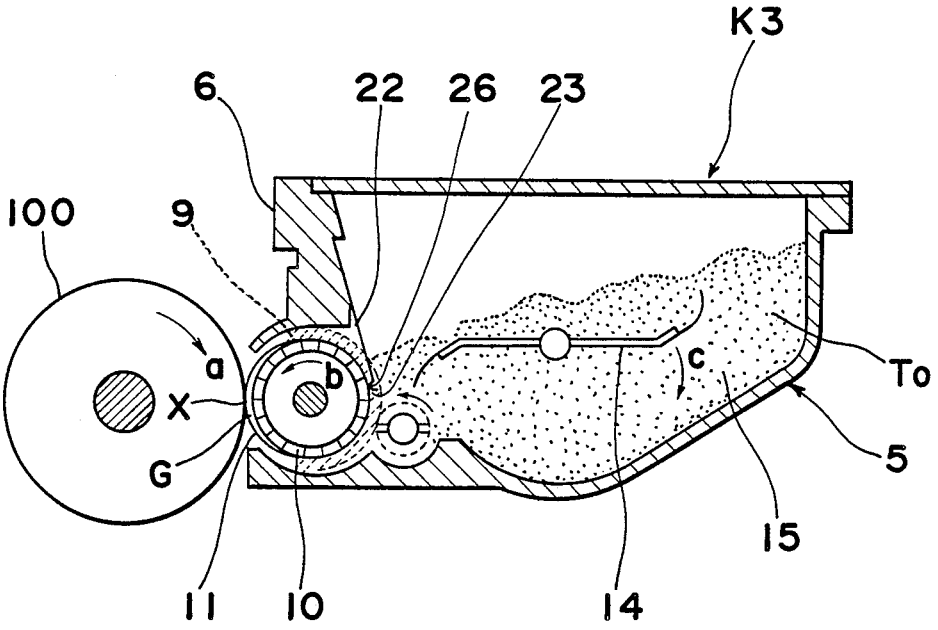
FIG. 12 is a schematic sectional view of a developing device according to a third embodiment of the present invention.
Figure 13:
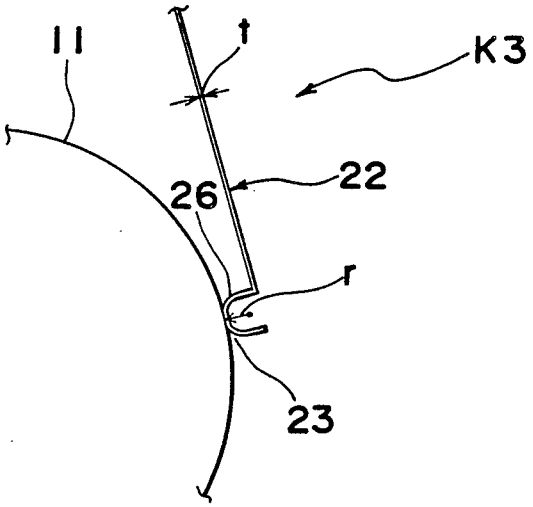
FIG. 13 is an enlarged side elevational view of a regulation member employed in the developing device of FIG. 12.

Hereinbelow, a developing device K3 according to a third embodiment of the present invention is described with reference to FIGS. 12 and 13. As shown in FIG. 12, the developing device K3 includes a regulation member 22 for regulating thickness of the toner layer on the drive roller 10. The regulation member 22 is formed by an elastic plate made of phosphor bronze and is attached to the rear face of the support member 6 provided above the drive roller 10. A circular portion 26 having a circular cross section is integrally formed at a distal end of the regulation member 22 by bending. The circular portion 26 of the regulation member 22 extends linearly in the axial direction of the filmy member 11 so as to be brought into pressing contact with an obliquely upper portion of a rear face of the drive roller 10 through the filmy member 11 at a contact pressure of about 5 g/mm. As shown in FIG. 13, a thickness t of the regulation member 22 is about 0.15 mm and a radius r of curvature of an outer peripheral surface of the circular portion 26 is about 0.50 mm. This regulation member 22 can be easily obtained by performing pressing working of a plate cut to a predetermined dimension. In the developing device K3, a peripheral speed of the photosensitive drum 100 is set at about 8.5 cm/sec., while a peripheral speed of the filmy member 11 is set at about 25.5 cm/sec.

A toner image formed on the photosensitive drum 100 is transferred onto a paper sheet and the toner image on the paper sheet is fixed thereon. It was found that prints thus finally obtained by the developing device K3 have excellent image quality regarding fog in the substrate, reproducibility of solid black, scatter of the toner around letters, etc.

An area S of a space 23 defined between the circular portion 26 and the filmy member 11 is described, hereinbelow. Generally speaking, when the radius r of curvature of the curved portion, i.e. the circular portion 26 of the regulation member 22 and the radius R of curvature of the toner support member, i.e. the filmy member 11 held in contact with the curved portion change, the space 23 defined between the curved portion and the toner support member, into which the toner advances, namely the wedgy region bounded by the curved portion and the toner support member changes, which exerts influences on amount of the toner adhering to the toner support member, etc. It is desirable that the area S of the space 23 defined between the toner support member and the curved portion falls in the following range:

$$0 < S \leqq 0.15\ mm^2.$$

Experiments have revealed that when the area S becomes far larger than 0.15 $mm^2$, fog, etc. undesirably appear in finally obtained images. In this embodiment, the radius R of curvature of the filmy member 11 is selected such that the equation: $0<S\leqq 0.15\ mm^2$ is satisfied.

In this embodiment, the developing device includes the toner support member having the movable surface for supporting the toner and the regulation member for electrically charging the toner supplied to the toner support member and for regulating amount of the toner adhering to the toner support member and has the following advantages. Namely, since the curved portion is employed in the regulation member, advantages of the regulation member provided with the curved portion can be achieved. Furthermore, since linearity of the curved portion of the regulation member is excellent, poor image quality such as non-uniform density, etc. of an image due to defective linearity of the curved portion can be obviated. Moreover, the regulation member not only can be easily manufactured even if the curved portion has a small radius of curvature but is suitable for mass production, thereby resulting in reduction of its production cost.

Meanwhile, this embodiment is not limited to the above mentioned developing device but can be applied to a conventional one-component type developing device and a replenishing device in a two-component type developing device.

Figure 14:
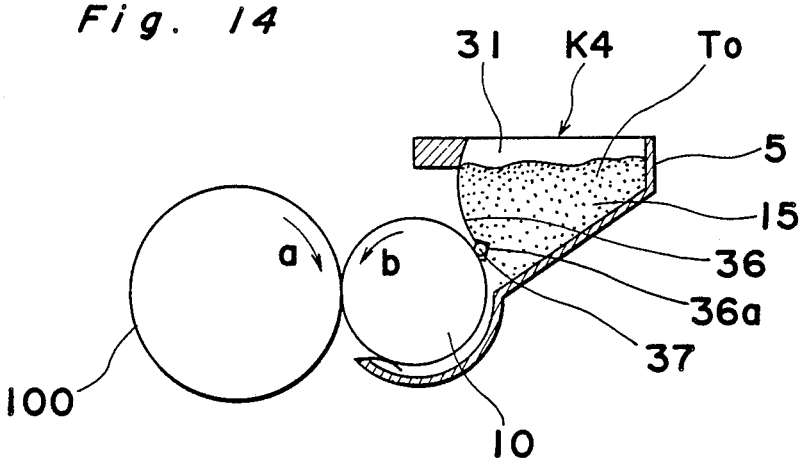
FIG. 14 is a schematic sectional view of a developing device according to a fourth embodiment of the present invention.

Hereinbelow, a developing device K4 according to a fourth embodiment of the present invention is described with reference to FIGS. 14 and 15. As shown in FIG. 14, the developing device K4 is disposed adjacent to the photosensitive drum 100 acting as an image support member. In the developing device K4, the toner tank 15 for storing the toner To acting as one-component developer is disposed at a position far away from the photosensitive drum 100. Meanwhile, the drive roller 10 acting as a toner support member for supplying the toner To to the photosensitive drum 100 is provided at one side of the toner tank 15 adjacent to the photosensitive drum 100 so as to be interposed between the photosensitive drum 100 and the toner tank 15 such that an outer peripheral surface of the drive roller 10 is brought into contact with an outer peripheral surface of the photosensitive drum 100. The drive roller 10 is driven by a roller (not shown) so as to be rotated in the direction of the arrow b opposite to the direction of the arrow a for the photosensitive drum 100. The toner To is arranged to be supplied from the toner tank 15 to the outer peripheral surface of the drive roller 10 through its contact or its electrostatic force.

Meanwhile, a regulation member 36 for regulating thickness of a toner layer on the drive roller 10 is provided above the drive roller 10 and is formed by an elastic plate. A substantially L-shaped retainer portion **36*a* is formed at a distal end of the regulation member 36 by bending such that an angular bending corner of the retainer portion 36*a* is oriented towards the toner tank 15. A cylindrical toner regulating rod 37 is rotatably retained by the retainer portion 36*a***.

The toner regulating rod 37 retained at the distal end of the regulation member 36 is brought into pressing contact with the toner To supplied onto the outer peripheral surface of the drive roller 10 so as to not only coat the toner To on the outer peripheral surface of the drive roller 10 thinly and uniformly but triboelectrically charge the toner To. Upon further rotation of the drive roller 10, the toner To on the outer peripheral surface of the drive roller 10 is supplied to the outer peripheral surface of the photosensitive drum 100.

Figure 15:
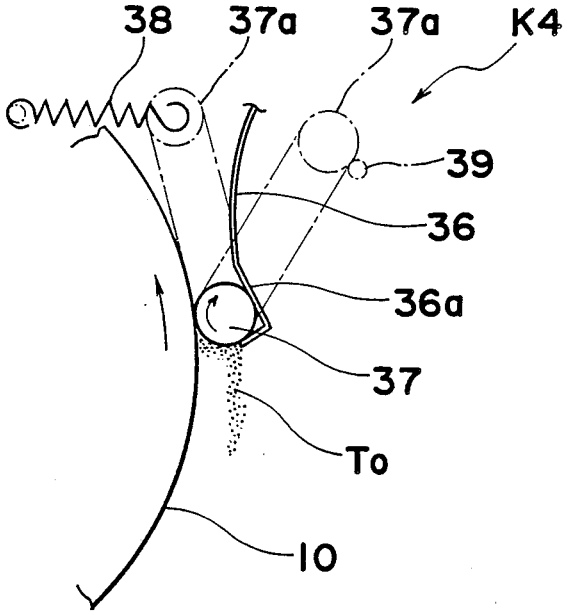
FIG. 15 is an enlarged fragmentary side elevational view of regulation member employed in the developing device of FIG. 14.

As shown in FIG. 15, the toner regulating rod 37 is projected in its axial direction outwardly from a side plate 31 of the developing device K4. One end portion **37*a* of the toner regulating rod 37 is bent such that the bent end portion 37*a* is urged towards the photosensitive drum 100 by a spring 38. On the other hand, a stopper 39 for stopping rotation of the toner regulating rod 37 is provided at one side of the regulation member 36 remote from the spring 38**.

By the above described arrangement of the developing device K4, when the drive roller 10 is not being rotated, the end portion **37*a* is held in such a state as to be urged towards the photosensitive drum 100 by the spring 38. Meanwhile, when the drive roller 10 is rotated, a rotational torque of the drive roller 10 is applied to the toner regulating rod 37 held in pressing contact with the drive roller 10, so that the toner regulating rod 37 is rotated towards the stopper 39 against an urging force of the spring 38 and thus, the end portion 37*a* is held in contact with the stopper 39. Then, when rotation of the drive roller 10 is stopped, the toner regulating rod 37 having the end portion 37*a* held in contact with the stopper 39 is rotated by action of the spring 38** so as to be returned to the original state.

As described above, the toner regulating rod 37 is rotated intermittently upon rotation and stop of the drive roller 10. Thus, even if the toner To adheres to the toner regulating rod when the toner regulating rod 37 is brought into pressing contact with the toner To supplied onto the outer peripheral surface of the drive roller 10, the toner regulating rod 37 is rotated in contact with the regulation member 36 and thus, the toner adhering to the toner regulating rod 37 is removed from the toner regulating rod 37 by the regulation member 36.

Meanwhile, in the developing device K4, the retainer portion **36*a* bent angularly is provided at the distal end of the regulation member 36 so as to retain the toner regulating rod 37. However, such retainer portion 36*a* is not necessarily required to be provided but it is only necessary to rotatably retain the toner regulating rod 37 at the distal end of the regulation member 36**.

Figure 16:
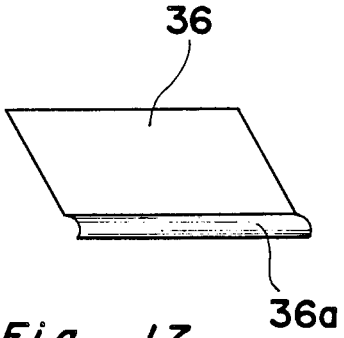
FIGS. 16 and 17 are perspective views showing variations of the regulation member of FIG. 15, respectively.
Figure 17:
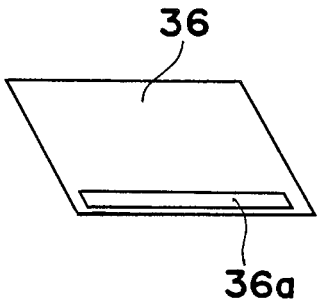

Furthermore, the retainer portion **36*a* is not limited to the angular shape referred to above. For example, the retainer portion 36*a* may be formed by bending the distal end of the regulation member 36 into a semicircular shape as shown in FIG. 16. Alternatively, as shown in FIG. 17, a slit is formed in the vicinity of the distal end of the regulation member 36 so as to be used as the retainer portion 36*a***.

Figure 18:
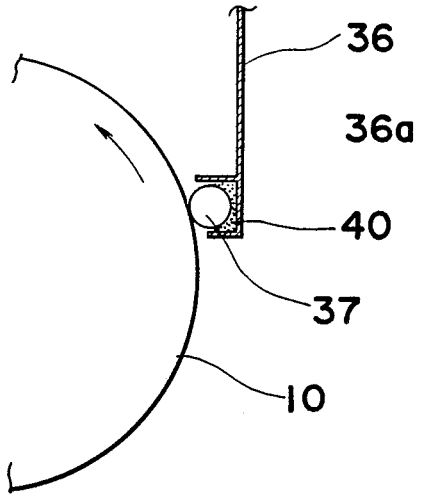
FIG. 18 is an enlarged fragmentary sectional view showing further variations of the regulation member of FIG. 15.

Meanwhile it can also be so arranged as shown in FIG. 18 that a substantially U-shaped retainer portion **36*a* is provided at the distal end of the regulation member 36 formed as a rigid body and an elastic member 40 is inserted into the retainer portion 36*a*. Thus, not only the toner regulating rod 37 is rotatably retained by the retainer portion 36*a* but the toner regulating rod 37 is pressed against the drive roller 10 by the elastic member 40 provided in the retainer portion 36*a***.

Figure 19:
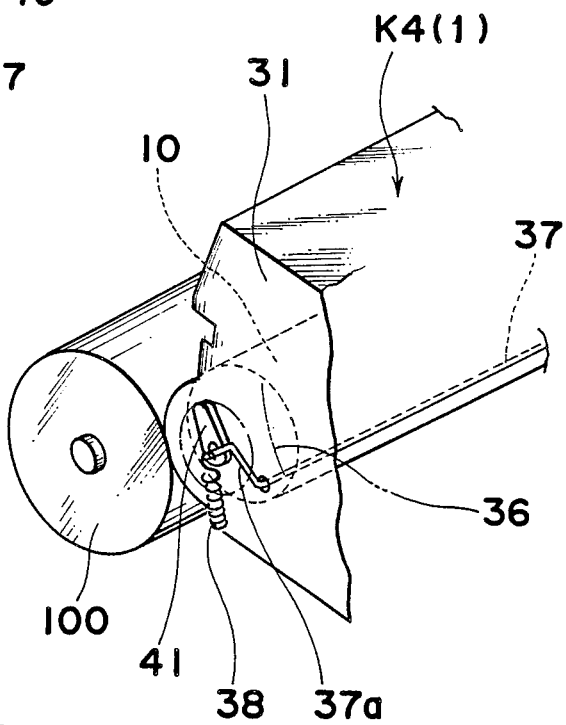
FIG. 19 is a fragmentary perspective view of a developing device which is a first modification of the developing device of FIG. 14.
Figure 20:
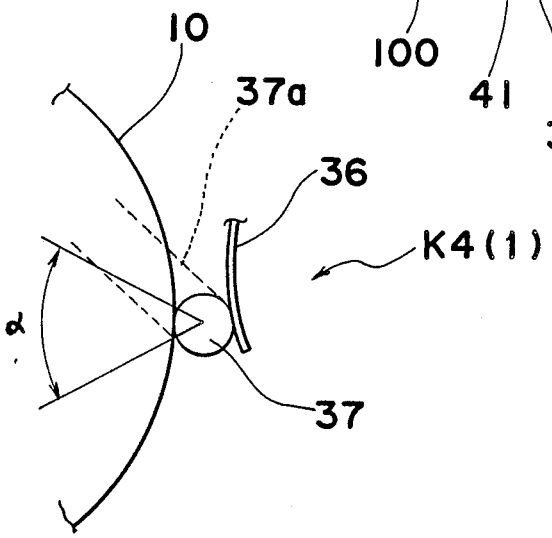
FIG. 20 is an enlarged fragmentary side elevational view of the developing device of FIG. 19.

Referring to FIGS. 19 and 20, there is shown a developing device K4(1) which is a first modification of the developing device K4. In the developing device K4(1), the retainer portion **36*a* is not provided at the distal end of the regulation member 36 formed by an elastic plate such that the cylindrical toner regulating rod 37 is pressed against the drive roller 10 by a distal end portion of the regulation member 36. The toner regulating rod 37** is projected in its axial direction from the side plate 31 of the developing device K4(1). The end portion 37*a* of the toner regulating rod 37 projecting out of the side plate 31 is bent into a hooked shape. Furthermore, a cam 41 is mounted on a shaft of the drive roller 10 projecting out of the side plate 31 such that the end portion 37*a* is brought into pressing contact with the cam 41 by the spring 38.

When the drive roller 10 is rotated in this state, the end portion 37*a* held in pressing contact with the cam 41 is displaced along the cam 41 by rotation of the cam 41 in response to rotation of the drive roller 10. Thus, the toner regulating rod 37 is pivoted within a range of an angle $\alpha$ shown in FIG. 20. When the toner regulating rod 37 is pivoted as described above in pressing contact with the toner To supplied onto the outer peripheral surface of the drive roller 10, amount of the toner To adhering to the toner regulating rod 37 is reduced. In addition, even in the case where toner To has adhered to the toner regulating rod 37, the toner To is removed from the toner regulating rod 37 through contact of the toner regulating plate 37 with the regulation member 36 upon pivoting of the toner regulating rod 37.

Figure 21:
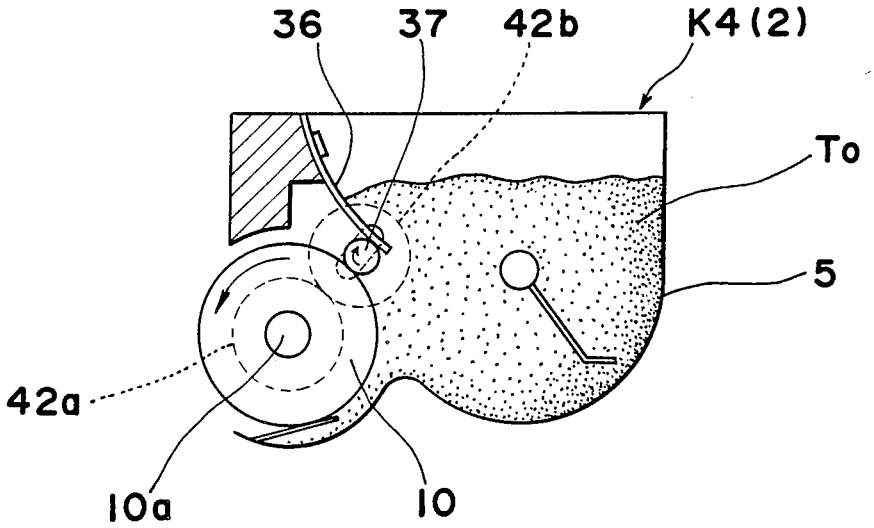
FIGS. 21, 22 and 23 are views similar to FIG. 14, particularly showing second, third and fourth modifications of the developing device of FIG. 14, respectively.

Referring to FIG. 21, there is shown a developing device K4(2) which is a second modification of the developing device K4. In the same manner as in the developing device K4(1), the cylindrical toner regulating rod 37 is pressed against the drive roller 10 by the distal end portion of the regulation member 36 formed by an elastic plate in the developing device K4(2). In the developing device K4(2), a shaft 10*a* of the drive roller 10 and the end portion 37*a* of the toner regulating rod 37 are axially projected out of the side plate 31 and gears 42*a* and 42*b* are, respectively, mounted on the shaft 10*a* and the end portion 37*a* so as to be in mesh with each other. Thus, upon rotation of the drive roller 10, the toner regulating rod 37 and the drive roller 10 are rotated continuously in opposite directions, respectively.

By the above described arrangement of the developing device K4(2), when the toner regulating rod 37 is continuously rotated in the direction opposite to that of the drive roller 10 while being held in pressing contact with the toner To supplied onto the outer peripheral surface of the drive roller 10, amount of the toner To adhering to the toner regulating rod 37 is lessened. Furthermore, even if the toner To has adhered to the toner regulating rod 37, the toner To is removed from the toner regulating rod 37 through contact of the toner regulating rod 37 with the regulation member 36 upon rotation of the toner regulating rod 37. Meanwhile, in the case where the toner regulating rod 37 is rotated in the direction opposite to that of the drive roller 10 as described above, it is desirable that speeds of the toner regulating rod 37 and the drive roller 10 are made different from each other such that thickness of the toner on the outer peripheral surface of the drive roller 10 is properly regulated by the regulation member 36.

Figure 22:
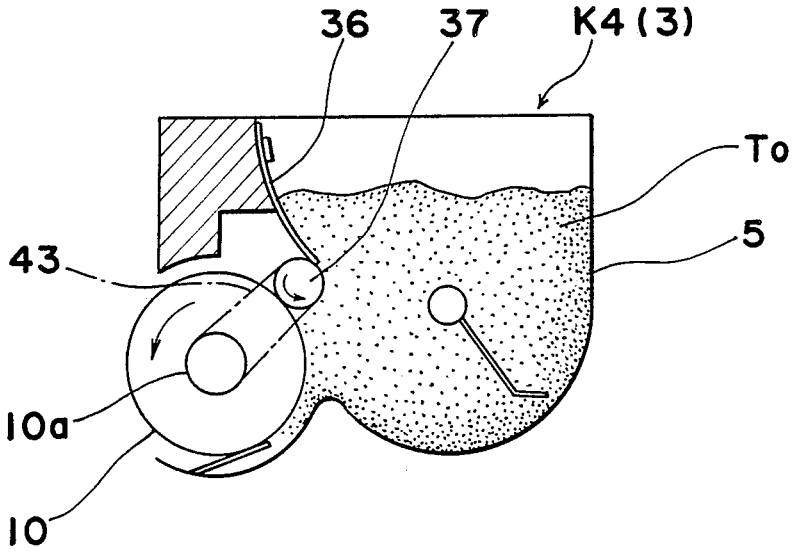

Referring further to FIG. 22, there is shown a developing device K4(3) which is a third modification of the developing device K4. In the developing device K4(3), a belt 43 is trained over the shaft 10*a* of the drive roller 10 and the end portion 37*a* of the toner regulating rod 37, which are axially projected out of the side plate 31. Hence, when the toner regulating rod 37 is continuously rotated in the direction identical with that of the drive roller 10 while being held in pressing contact with the toner To supplied onto the outer peripheral surface of the drive roller 10, amount of the toner To adhering to the toner regulating rod 37 at the time of pressing contact of the toner regulating rod 37 with the toner To is decreased. Moreover, even if the toner To has adhered to the toner regulating rod 37, the toner To is removed from the toner regulating rod 37 through contact of the toner regulating rod 37 with the regulation member 36 upon rotation of the toner regulating rod 37.

Meanwhile, in the case where the toner regulating rod 37 and the drive roller 10 are rotated in the identical direction, it is desirable that the speed of the drive roller 10 is so set as to be higher than that of the toner regulating roller 10 such that thickness of the toner To on the drive roller 10 is properly regulated by the toner regulating rod.

Figure 23:
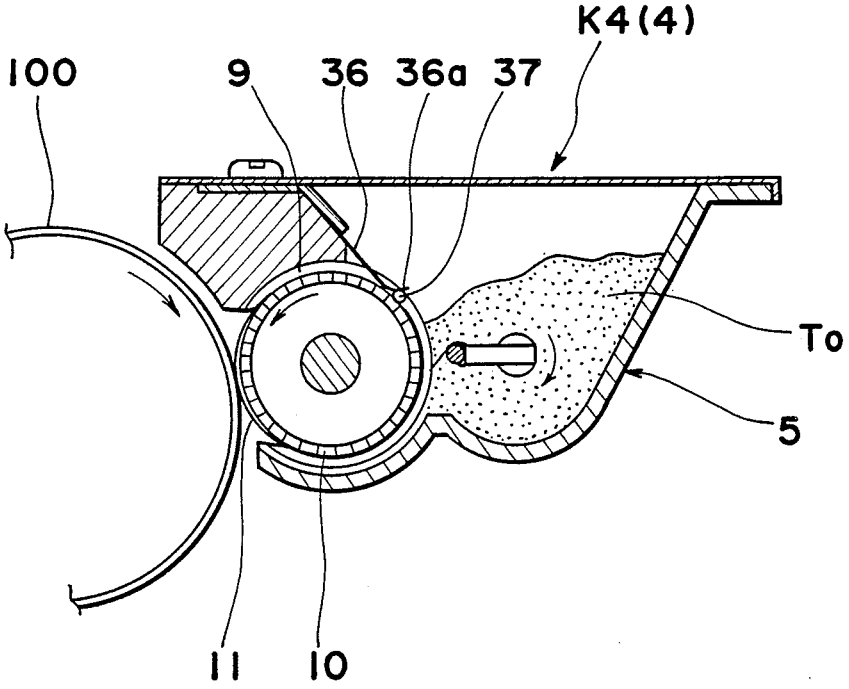

Referring finally to FIG. 23, there is shown a developing device K4(4) which is a fourth modification of the developing device K4. In the developing device K4(4), the filmy member 11 having a peripheral length larger than that of the drive roller 10 is provided as the toner support member for supplying the toner To to the photosensitive drum 100. The filmy member 11 is loosely fitted around the drive roller 10 disposed adjacent to the photosensitive drum 100. A pair of guide members 9 are provided at opposite end portions of the filmy member 11 so as to not only depress the filmy member 11 against the drive roller 10 at a location not confronting the photosensitive drum 100 but project the filmy member 11 from the drive roller 10 towards the photosensitive drum 100. The projected filmy member 11 is brought into light contact with the surface of the photosensitive drum 100 so as to supply the toner To to the photosensitive drum 100.

Meanwhile, in the same manner as in the developing device K4, the cylindrical toner regulating rod 37 is rotatably retained by the angular retainer portion 36*a* provided at the distal end of the regulation member 36 formed by an elastic plate. Thus, at a location where the filmy member 11 is depressed against the drive roller 10 by the guide members 9, the toner regulating rod 37 not only is brought into pressing contact with the toner To supplied to the surface of the filmy member 11 but is rotated. Any one of the above described drive means employed in the developing devices K4, K4(1), K4(2) and K4(3) may be used for rotating the toner regulating rod 37.

As is clear from the foregoing, in the developing device K4 according to the fourth embodiment of the present invention, when thickness of the toner on the surface of the toner support member is regulated by the toner regulating rod provided at the distal end of the regulation member, the toner regulating rod is rotated continuously or intermittently. Accordingly, the toner is less likely to adhere to the toner regulating rod. Furthermore, even if the toner has adhered to the toner regulating rod, the toner regulating rod is rotated through its contact with the regulation member, etc. and thus, the toner is removed from the toner regulating rod. As a result, in the developing device K4 of the present invention, such a problem associated with the prior art developing devices does not arise that irregular portions of non-uniform streaky shape appear, through adherence of the toner to the toner regulating rod, in the toner layer formed on the toner support member. Therefore, the toner layer is uniformly formed on the surface of the toner support member and excellent image quality can be obtained stably.

In addition, the retainer portion formed by the bent portion, the slit, etc. is provided at the distal end of the regulation member. Therefore, when the toner regulating rod is set in the retainer portion, the toner regulating rod is not required to be attached to the distal end of the regulation member by using adhesive but can be easily set in the retainer portion of the regulation member without distortion of the toner regulating rod.

As a result, such disadvantages of the prior art developing devices are not incurred that due to distortion of the toner regulating rod or ooze of the adhesive, irregular portions are formed in the toner layer on the surface of the toner support member with the result that irregularities in density are produced on the image.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A developing device comprising:

a toner support member for supporting toner on its surface, which is so provided as to confront an electrostatic latent image support member; and a regulation member for forming a thin layer of the toner on said toner support member;

said regulation member including a curved member for pressing said toner support member and a support member for supporting said curved member;

wherein an area S of a space satisfies an equation:

$$0<S\leqq 0.15\ mm^2$$

where the area is defined in a plane containing a circle of curvature of said toner support member and a circle of curvature of said curved member and is bounded by said toner support member, said curved member and a line;

the line being drawn in parallel with a normal extending through a point of contact between said toner support member and said curved member and being spaced a radius of curvature of said curved member from the normal at an upstream side of the normal in a direction of rotation of said toner support member.

2. A developing device as claimed in claim 1, wherein said curved member is a cylinder longitudinally extending in an axial direction of said toner support member.

3. A developing device as claimed in claim 1, wherein said toner support member is constituted by a drive roller and a tubular filmy member which has a peripheral length larger than that of said drive roller so as to be loosely fitted around said drive roller.

4. A developing device as claimed in claim 3, further comprising means which brings a portion of said filmy member into pressing contact with said drive roller so as to form a slack of said filmy member at a location confronting said electrostatic latent image support member.

5. A developing device comprising:

a toner support member for supporting toner on its surface, which is so provided as to confront an electrostatic latent image support member; and a regulation member for forming a thin layer of the toner on said toner support member;

said regulation member being formed by a plate having a curved portion for pressing said toner support member and a support portion for supporting said curved portion;

said curved portion being formed by integrally bending said plate.

6. A developing device as claimed in claim 5, wherein an area S of a space satisfies an equation:

$$0<S\leqq 0.15\ mm^2$$

where the area is defined in a plane containing a circle of curvature of said toner support member and a circle of curvature of said curved portion and is bounded by said toner support member, said curved portion and a line;

the line being drawn in parallel with a normal extending through a point of contact between said toner support member and said curved portion and being spaced a radius of curvature of said curved portion from the normal at an upstream side of the normal in a direction of rotation of said toner support member.

7. A developing device as claimed in claim 5, wherein said toner support member is constituted by a drive roller and a tubular filmy member which has a peripheral length larger than that of said drive roller so as to be loosely fitted around said drive roller.

8. A developing device as claimed in claim 7, further comprising means which brings a portion of said filmy member into pressing contact with said drive roller so as to form a slack of said filmy member at a location confronting said electrostatic latent image support member.

9. A developing device comprising:

a rotatable drive roller which is so provided as to confront an electrostatic latent image support member;

a filmy member which has a peripheral length larger than that of said drive roller so as to be loosely fitted around said drive roller;

a slack forming means which brings a portion of said filmy member into pressing contact with said drive roller so as to form a slack of said filmy member at a location confronting said electrostatic latent image support member; and a regulation member for forming a thin layer of the toner on said filmy member;

said regulation member being constituted by a curved member for pressing an external surface of said filmy member and a support member for supporting said curved member;

said curved member being made of a material having a polarity opposite to that of the toner in frictional series of the toner.

10. A developing device as claimed in claim 9, wherein said curved member is a cylinder longitudinally extending in an axial direction of said filmy member.

11. A developing device as claimed in claim 9, wherein said slack forming means has an arcuate internal surface corresponding substantially to a shape of an external surface of said drive roller so as to be brought into pressing contact with said drive roller through said filmy member and is formed, at its portion confronting said electrostatic latent image support member, with an opening.

12. A developing device as claimed in claim 9, wherein the arcuate internal surface of said slack forming means has a central angle ranging from 180° to 270°.

13. A developing device as claimed in claim 9, wherein said regulation member presses said filmy member in a region in which said filmy member is brought into pressing contact with said drive roller by said slack forming means.

14. A developing device comprising:

a toner support member for supporting toner on its surface, which is so provided as to confront an electrostatic latent image support member; and a regulation member for forming a thin layer of the toner on said toner support member;

said regulation member being constituted by a curved member for pressing said toner support member and a support member for rotatably supporting said curved member.

15. A developing device as claimed in claim 14, wherein said curved member is a cylinder longitudinally extending in an axial direction of said toner support member.

16. A developing device as claimed in claim 14, wherein a distal end portion of said support member is angularly bent so as to support said curved member.

17. A developing device as claimed in claim 14, wherein a distal end portion of said support member is semicircularly bent so as to support said curved member.

18. A developing device as claimed in claim 14, wherein a U-shaped retainer portion for supporting said curved member is provided at a distal end portion of said support member.

19. A developing device as claimed in claim 14, further comprising a rotary means for forcibly rotating said curved member.

20. A developing device as claimed in claim 19, wherein said rotary member comprises:

a hooked bent end of said curved member, which projects out of one side of said developing device;

a cam which is mounted on a portion of a shaft of said toner support member;

said portion of said shaft projecting out of said side of said developing device; and an urging means for pressing said hooked bent end of said curved member against said cam.

21. A developing device as claimed in claim 19, wherein said rotary means comprises:

a first gear which is mounted on one end of said curved member;

said end of said curved member projecting out of one side of said developing device; and a second gear which is mounted on a shaft of said toner support member so as to be brought into engagement with said first gear;

said shaft projecting out of said side of said developing device.

22. A developing device as claimed in claim 14, wherein said toner support member is constituted by a drive roller and a tubular filmy member, said filmy member having a peripheral length larger than that of said drive roller so as to be loosely fitted around said drive roller.

23. A developing device as claimed in claim 22, further comprising means which brings a portion of said filmy member into pressing contact with said drive roller so as to form a slack of said filmy member at a location confronting said electrostatic latent image support member.

24. A developing device as claimed in claim 19, wherein said rotary means comprises a belt trained over one end of said curved member and one end of said toner support member, said end of said curved member and said end of said toner support member projecting out of one side of said developing device.

25. A developing device as claimed in claim 20, wherein said urging means is a spring.

* * * * *